United States Patent [19]

Arendt et al.

[11] 4,164,977

[45] Aug. 21, 1979

[54] WELL LATCH

[75] Inventors: Henry P. Arendt; Thomas M. Deaton, both of Dallas; Donald L. Dooley, Royse City, all of Tex.

[73] Assignee: Otis Engineering Corporation, Dallas, Tex.

[21] Appl. No.: 786,380

[22] Filed: Apr. 11, 1977

[51] Int. Cl.[2] ..... E21B 23/06; E21B 33/126; E21B 33/129

[52] U.S. Cl. ..... 166/125; 166/128; 166/137; 166/152

[58] Field of Search ..... 166/125, 128, 137, 152

[56] References Cited

U.S. PATENT DOCUMENTS

| | | | |
|---|---|---|---|
| 2,760,581 | 8/1956 | Johnston | 166/128 |
| 2,976,931 | 3/1961 | Dattin | 166/125 |
| 3,208,531 | 9/1965 | Tamplen | 166/125 |
| 3,633,670 | 1/1972 | Brown | 166/128 |
| 3,789,925 | 2/1974 | Brown | 166/125 X |

*Primary Examiner*—William Pate, III
*Attorney, Agent, or Firm*—Vinson & Elkins

[57] ABSTRACT

Disclosed is a well latch for locking well tools in a well flow conductor. The latch housing has a pressure equalizing passage extending through its wall. A valve controls flow through the equalizing passage. Keys, carried by the latch housing, are expanded outwardly into a locking groove of a well flow conductor to lock the well latch therein. A fishing neck, associated with the latch, permits retrieval of the latch. This abstract is neither intended to define the scope of the invention, which, of course, is measured by the claims, nor is it intended to be limiting in any way.

19 Claims, 9 Drawing Figures

WELL LATCH

BACKGROUND OF THE INVENTION

A. Field of the Invention

This invention relates to a latch for locking well tools in a well flow conductor. The latch has radially expandable locking keys and also has a valve controlled pressure equalizing fluid passage.

B. The Prior Art

U.S. Pat. No. 3,208,531 to Tamplen issued Sept. 28, 1965 and titled "INSERTING TOOL FOR LOCATING AND ANCHORING A DEVICE IN TUBING" discloses a latch for locking tools in a well flow conductor which has radially expandable locking keys.

The use of an equalizing sub, having a valve controlled pressure equalizing fluid passageway, in conjunction with a latch having radially expandable locking keys, is disclosed on pages 3957 through 3969 of the "COMPOSITE CATALOG OF OIL FIELD EQUIPMENT AND SERVICES", 1974–1975 edition.

These latches and equalizing subs are satisfactory when the well is equipped for service with wire line equipment. However, they could not be used if the well is to be serviced with pumpdown equipment. The length of the disclosed latches is such that the latches are too long to be able to negotiate the bend or curved tubing through which pumpdown equipment must pass. The disclosed equalizing subs simply add length to the latch.

Pumpdown latches have been devised. It has been the practice to position the valved equalizing passage utilized with a pumpdown latch in a separate sub. The sub extends below the latch and is connected thereto by a swivel joint. (See page 4077 of the "COMPOSITE CATALOG OF OIL FIELD EQUIPMENT AND SERVICES" 1974–1975 edition). Such a conventional pumpdown latch and equalizing sub arrangement has several limitations. First, the swivel joint cannot withstand a high pressure differential. Therefore, the pressure range of the latch is limited to the pressure differential that may be withstood by the swivel joint. Second, opening the equalizing passage in the equalizing sub prior to retrieval of the latch is difficult. With the equalizing sub below the latch, a prong must be inserted through the latch bore to move the valve within the equalizing sub. The prong is slightly longer than the length of the latch and is joined to a pumpdown retrieving tool with a swivel joint. To properly align such a prong so that it may pass through the bore of a latch and actuate a valve in an equalizing sub is exceedingly difficult.

OBJECTS OF THE INVENTION

An object of this invention is to provide a well latch which overcomes the above noted deficiencies in present pumpdown latches.

Another object of this invention is to provide a short well latch, incorporating a valve-controlled equalizing passage, so that the latch may make up one short section of a pumpdown tool train.

Another object of this invention is to provide a well latch having a valve-controlled equalizing passage wherein the valve can be moved to a position opening the equalizing passage without the use of a long prong.

Another object of this invention is to provide a well latch having radially expandable locking keys and having a back-up expander for maintaining the keys in expanded position wherein the distance that the expander undergoes to back up the keys is less than presently required.

Another object of this invention is to provide a well latch having a valve-controlled equalizing passage, radially expandable locking keys, and a back-up key expander which is releasably maintained in either one of its two operative positions.

Another object of this invention is to provide a well latch having a valve-controlled equalizing passage wherein the valve is held in a position opening the passage until the latch is landed and locked in a well flow conductor.

Another object of this invention is to provide a well latch incorporating a valve-controlled equalizing passage and including a fishing neck, wherein after the latch is landed and locked in a well flow conductor with the valve closing the equalizing passage, the fishing neck cannot be engaged by a fishing tool until the valve has opened the equalizing passage.

Another object of this invention is to provide a well latch incorporating a valve-controlled equalizing passage and including a load ring for improved force transmission from the fishing tool to the latch housing during retrieval of the latch.

These and other objects and features of advantage of this invention will be apparent from the drawings, the detailed description, and the appended claims.

DESCRIPTION OF THE DRAWINGS

In the drawings wherein like numerals indicate like parts and wherein illustrative embodiments of this invention are shown.

DESCRIPTION OF THE PREFERRED EMBODIMENTS

A well flow conductor often includes one or more landing nipples in which a latch will be landed and locked. Either the latch or the latch running tool will have means for locating the latch with respect to the landing nipple. After the latch is located, the running tool is manipulated to lock the latch within the landing nipple. Various well equipment may be associated with the latch. The well equipment may control flow through the well flow conductor or perform other operations in the well while locked in the well flow conductor by the latch.

If a pressure differential will exist across the latch and the locked well equipment, a valved equalizing fluid passage is preferably provided. The equalizing passage generally is open during running of the latch and well equipment and is closed upon landing and locking the latch in the landing nipple. Prior to retrieval of the latch and well equipment, the equalizing passage is opened. Pressures are thereby equalized across the latch. Thereafter, the latch and associated well equipment may be safely unlocked and removed from the well flow conductor under control conditions without being moved quickly in the well due to shut in well pressure below the latch.

The latch of this invention is designed for use in pumpdown installations. Pumpdown equipment enters the well through either a loop or curved portion of tubing. A pumpdown tool train is therefore comprised of a plurality of short tool sections. Each tool section is short enough to be able to negotiate the loop or curved tubing and is connected to the other tool sections by universal joints. The latch of this invention is short and makes up one section of the pumpdown tool train. The latch itself includes the valve controlled pressure equalizing passage. The expander, which backs up the radially expandable locking keys of the latch, has a shortened distance of travel between its key back-up position and non back-up position vis-a-vis present expanders. The latch also includes a fishing neck which is engaged by a pulling tool to retrieve the latch. The fishing neck and the equalizing valve of the latch are designed so that the fishing neck cannot be engaged by the pulling tool until the equalizing valve has opened the pressure equalizing passage. However, a long prong is not necessary to move the equalizing valve.

Figure 1:
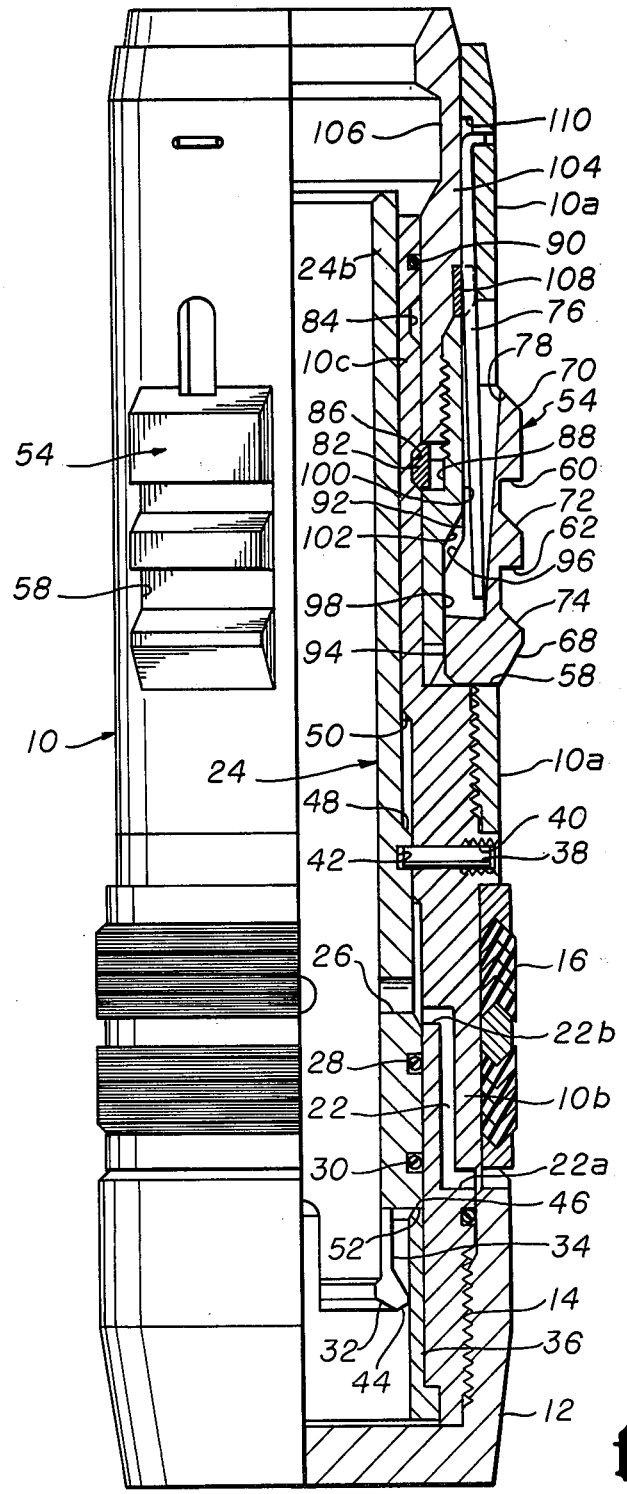
FIG. 1 is a quarter-sectional view of one embodiment of the latch.

The detailed structure of a first embodiment of a latch, structured in accordance with this invention, is illustrated in FIG. 1.

The latch housing 10 is short enough to comprise one section of a pumpdown tool train. Its length enables it to pass through the conventional loop or curved portion of tubing prior to entry into the well. The housing 10 includes interconnected tubular sections 10*a* and 10*b*.

The well equipment to be run in the well flow conductor and locked in place by the latch may be attached to the housing 10. The illustrated well equipment 12 is a plug or cap which is attached to the tubular housing section 10*b* by threaded connection 14.

Figure 2:
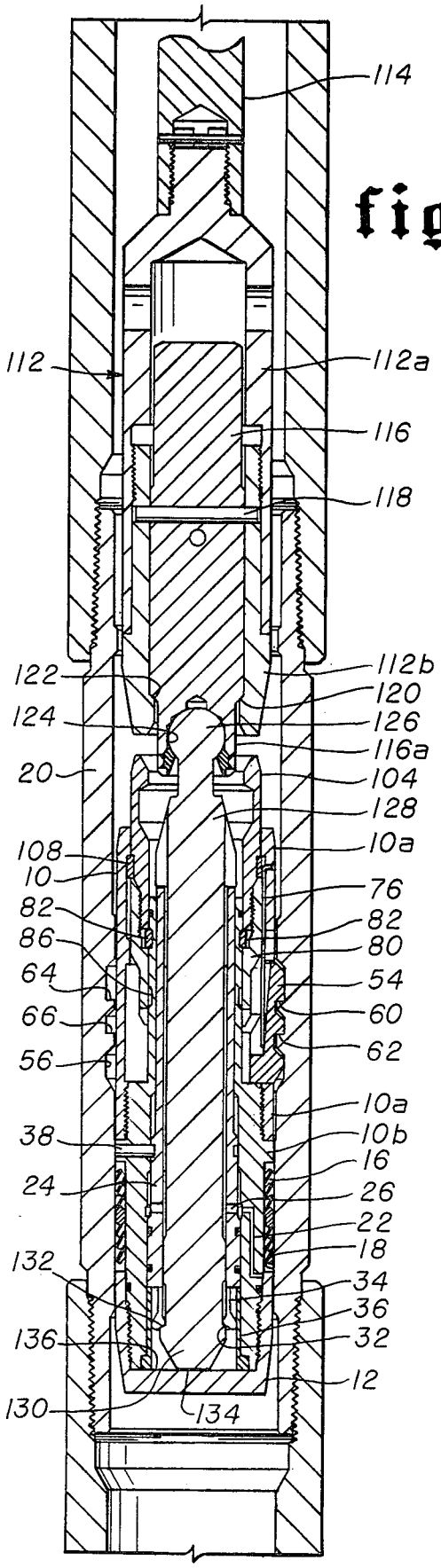
FIG. 2 is a sectional view of the latch of FIG. 1 together with its running tool illustrating the latch being located in a landing nipple of a well conduit.

Carried on latch housing 10 is seal means 16 for sealing between the housing 10 and the inner wall 18 of the landing nipple 20 (see FIG. 2). When seal means 16 is in its seal effective position, two pressure regions are formed in the well flow conductor. One pressure region is located on the same side of seal means 16 as is the well equipment 12. The other pressure region is located on the side of seal means 16 which is opposite from the well equipment 12.

Pressure equalizing passage means 22 extends through the housing 10 between a region of pressure exterior of the housing and a region of pressure interior of the housing. The exterior pressure region would be the one pressure region located on the same side of seal means 16 as is the well equipment 12. The interior pressure region is in communication with the other pressure region on side of seal means 16 which is opposite the well equipment 12. The openings of the equalizing passage means 22 at the exterior and interior of the housing 10 are positioned to reduce, as much as possible, the overall longitudinal length of latch housing 10. The opening 22*a* at the exterior of the housing 10 is adjacent to seal means 16. The longitudinal length of latch housing 10 which accommodates equalizing passage means 22 is, therefore, no longer than the longitudinal length of seal means 16 plus the width of the equalizing passage means opening 22*a*. Equalizing passage means 22 has an opening 22*b* interior of the housing 10 positioned so that valve means 24, which is movable between positions permitting and preventing flow through interior opening 22*b*, does not extend beyond the extremities of latch housing 10 during its movement. As shown, the interior opening 22*b* of equalizing passage means 22 need not be aligned with the exterior opening 22*a*. Instead, passage means 22 includes a vertical portion extending between the two openings 22*a* and 22*b*.

Valve means 24 controls fluid flow through equalizing passage means 22. Valve means 24 permits flow through equalizing passage means 22 during running of the latch into the well flow conductor. It blocks flow through equalizing passage means 22 after the latch has been landed and locked in its landing nipple 20. Before the latch is unlocked from the landing nipple 20, valve means 24 is returned to its former position permitting flow through pressure equalizing passage means 22. For controlling flow through equalizing passage means 22, valve means 24 is movable between a first position (see FIG. 1) permitting flow through equalizing passage means 22 and a second position (see FIG. 4) preventing flow through the equalizing passage means 22. Valve means 24 includes port means 26, which are substantially aligned with the interior opening 22*b* of passage means 22 when valve means 24 is in its first position, to permit free flow of fluids through passage means 22. Spaced seal means 28 and 30 are carried by valve means 24. The spaced seal means 28 and 30 seal between valve means 24 and the interior surface of latch housing 10. They span the interior opening 22*b* of equalizing passage means 22 when valve means 24 is in its second position (see FIG. 4). When seal means 28 and 30 span the opening 22*b*, flow through equalizing passage means 22 is prevented.

Valve means 24 also engages the running tool prong while the latch is being run into the well flow conductor. The engagement of valve means 24 with the running tool prong joins the latch to the pumpdown tool train. Once the latch is landed and locked in the landing nipple 20, valve means 24 releases the running tool prong. Thereafter the running tool and pumpdown tool train may be retrieved from the well flow conductor leaving the latch and associated well equipment 12 landed and locked in the landing nipple 20.

A lower, inwardly facing shoulder 32 of valve means 24 is adapted to selectively engage the running tool prong and release the running tool prong. The inwardly facing shoulder 32 is formed on the lower end of resilient, inherently outwardly expandable collet fingers 34 associated with valve means 24. When valve means 24 is in its first position (see FIG. 1), the collet fingers 34 are collapsed and confined inwardly. The inward confinement of collet fingers 34 enables the engagement of the head of a running tool prong by inwardly facing shoulder 32. When valve means 24 is in its second position (see FIG. 4) the collet fingers 34 inherently assume an outwardly expanded position. The outwardly expanded position of the collet fingers 34 enables the head of a running tool prong to pass through inwardly facing shoulder 32. Latch housing 10 is provided with a reduced internal diameter by sleeve 36. Sleeve 36 collapses and confines collet fingers 36 inwardly when valve means 24 is in its first position. The length of sleeve 36 is such that collet fingers 34 are free to expand outwardly when valve means 24 is in its second position.

While the latch is being run into the well flow conductor, valve means 24 is releasably held in its first position, wherein collet fingers 34 are confined inwardly, so that the running tool prong head is not prematurely released and the latch separated from the pumpdown tool train. The illustrated releasable holding means comprises shear pin 38. Shear pin 38 is threaded into a socket 40 in the housing 10 and projects into a groove 42 of valve means 24. It, therefore, releasably holds valve means 24 in its first position with respect to the latch housing 10.

After the latch is landed and locked in the landing nipple 20, valve means 24 is moved to its second position preventing flow through equalizing passage means 22. Thereafter, valve means 24 is prevented from returning to its first position permitting flow through equalizing passage means 22 until it is desired to unlock the latch from the landing nipple. Releasable stop means, coacting between valve means 24 and the latch housing 10, prevent an unintentional movement of valve means 24 from its second position to its first position. The illustrated releaseable stop means comprises the lower outwardly facing shoulder 44 of collet fingers 34 and the upper end 46 of sleeve 36.

After shear pin 38 is sheared, valve means 24 is stopped when it reaches its second position by the engagement of an upwardly facing shoulder 48 of valve means 24 with a downwardly facing shoulder 50 within the latch housing 10. When valve means 24 is returned to its first position, its movement is stopped by the engagement of a downwardly facing shoulder 52 of valve means 24 with the upper end 46 of sleeve 36.

Radially movable key means 54 lock the latch in the recess 56 of the landing nipple 20. Key means 54 are carried by the latch housing 10 and are movable radially with respect to the latch housing 10 within windows 58 formed in tubular housing section 10*a*. The outer profile of key means 54 is designed to mate with the inner profile of landing nipple recess 56. The radial outward expansion of key means 54 into the recess 56 and the maintenance of key means 54 in an expanded position locks the latch in the landing nipple 20.

The latch is located with respect to the landing nipple 20, with key means 54 adjacent the landing nipple recess 56, by the engagement of downwardly facing shoulders 60 and 62 of key means 54 with upwardly facing shoulders 64 and 66 of recess 56. During downward movement of the latch through a well flow conductor, a lower chamfered shoulder 68 of key means 54 engages restrictions in the flow conductor and cams key means 54 inwardly. During upward movement of the latch through a well flow conductor, upward facing chamfered surfaces 70, 72 and 74 of key means 54 engage restrictions in the flow conductor and cam key means 54 inwardly. Such camming action enables the latch to by-pass restrictions in the well flow conductor.

Inherently resilient urging means, such as spring means 76, biases key means 54 radially outwardly with respect to the latch housing 10. To enable retraction of key means 54 into the latch housing 10, without interference due to the physical size of spring means 76, spring means 76 is disposed in a slot 78 formed in key means 54.

Expander means 80 expands key means 54 to their outermost position and thereafter backs up key means 54 to maintain them in that position. Expander means 80 is axially movable with respect to the latch housing 10 between a first and second position. In its first position, expander means 80 does not engage key means 54. Key means 54 is capable of completely retracting into the windows 58 of the latch housing 10. In its second position, expander means 80 engages key means 54 and maintains key means 54 in their outermost position.

Expander means 80 is prevented from inadvertently shifting between its first and second positions. Once in one of its first or second positions, expander means 80 is releasably maintained in that position. The illustrated releasable maintaining means for expander means 80 comprises an expandable and contractible detent ring means 82 which engages one of two spaced groove means 84 and 86. The expandable and contractible detent means 82 may be carried by one of expander means 80 and the latch housing 10 with the groove means 84 and 86 being in the other. Because of space limitations, in the illustrated latch, the expandable and contractible detent ring means 82 is carried within a recess 88 of expander means 80. The spaced groove means 84 and 86 are located in an upper extension 10*c* of the tubular housing section 10*b*. Detent ring means 82 releasably engages groove means 84 when expander means 80 is in its first position and releasably engages groove means 86 when expander means 80 is in its second position (see FIG. 1). Seal means 90 is disposed around the upper extension 10*c* of housing section 10*b* above the spaced groove means 84 and 86. Seal means 90 engages the inner wall of fishing neck means 104 and prevents sand from seeping into the spaced groove means 84 and 86. Seepage of sand into the spaced groove means 84 and 86 would inhibit the operation of detent ring means 82.

Key means 54 and expander means 80 are stepped to minimize the distance between the first and second positions of expander means 80. Minimizing the distance through which expander means 80 moves enables a corresponding minimization of the longitudinal length of the latch. Key means 54 and expander means 80 are also designed to avoid the formation of sand trap areas. As seen in FIG. 1, key means 54 has an inwardly facing stepped surface including a first surface 92 forming one step, a second surface 94 forming a second step, and a tapered surface 96 extending therebetween. Expander means 80 has an outer stepped portion sized to engage the stepped surfaces 92 and 94 of the key means 54 when expander means 80 is in its second position and sized to permit complete retraction of key means 54 into the latch housing 10 when expander means 80 is in its first position. The outer stepped portion of expander means 80 includes a reduced outside diameter portion 98, an enlarged outside diameter portion 100, and a tapered portion 102 extending between the reduced and enlarged diameter portions 98 and 100, respectively. When expander means 80 is in its first position (see FIG. 2), its reduced diameter portion 98 is disposed behind the one step surface 92 of key means 54. When expander means 80 is in its second position, its enlarged diameter portion 100 engages the one step surface 92 of key means 54 and its reduced diameter portion 98 engages the second step surface 94 of key means 54. The distance through which expander means 80 moves between its first and second positions is less than the length of key means 54 by at least approximately the length of the coacting stepped surface of key means 54 and the stepped portion of expander means 80.

The latch is retrieved from the landing nipple 20 by the engagement of a pulling tool with fishing neck means 104 associated with expander means 80. To minimize the longitudinal length of the latch, a major portion of fishing neck means 104 is received within the latch housing 10.

An upward application of force to the pulling tool moves fishing neck means 104 upwardly and thereby moves expander means 80 to its first position. A continued upward application of force to the pulling tool will result in fishing neck means 104 transmitting that force to the latch housing 10. Key means 54 is cammed inwardly and out of locking engagement with the landing nipple recess 56. Thereafter, the latch may be retrieved from the well flow conductor.

For engagement with the appropriate pulling tool, fish neck means 104 includes an internal recess 106. When valve means 24 is in its second position, its upward extension **24*b* prevents a pulling tool from engaging the fishing neck recess 106. When valve means 24 is in its first position, the extension 24*b* no longer interferes with the engagement of recess 106 by a pulling tool (see FIG. 1**).

When the latch is being retrieved from the well flow conductor, upward forces are transmitted by the pulling tool to fising neck means 104. Fishing neck means 104 in turn applies an upward force to latch housing 10. The latch includes appropriate load bearing shoulders, one shoulder 108 is associated with fishing neck means 104 and the other shoulder 110 is on latch housing 10. The shoulders 108 and 110 engage during this upward transmission of forces. Preferably, the one shoulder 108 associated with fishing neck means 104 is provided by load ring means 108. Load ring means 108 permits an easier fabrication and assembly of parts. Additionally, it may be formed from a special material to reduce the likelihood of damage during use.

Figure 3:
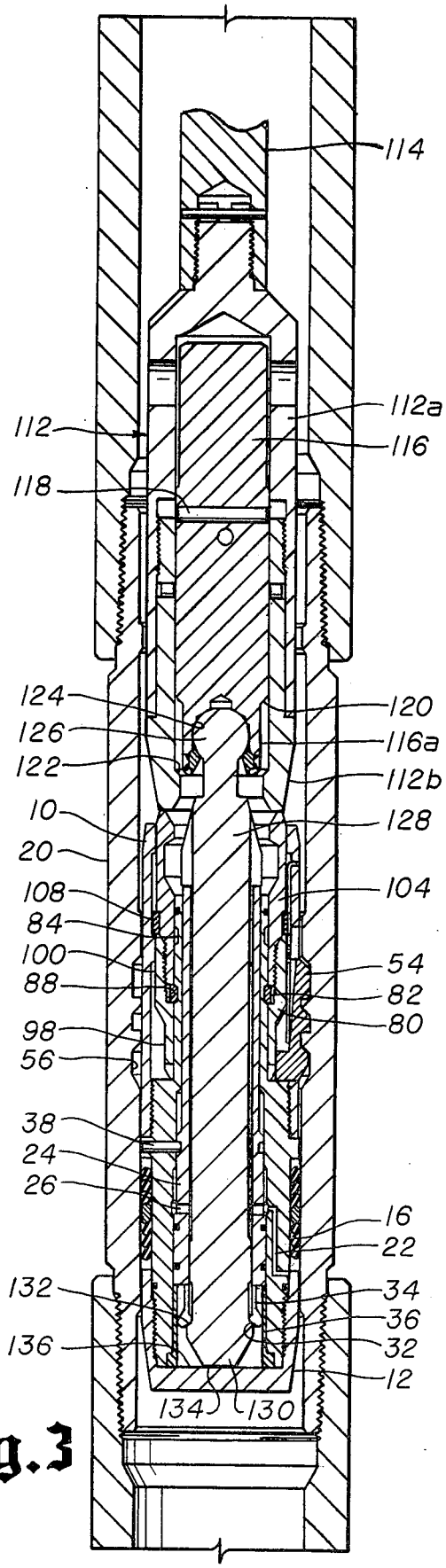
FIG. 3 is a sectional view of the latch and running tool of FIG. 2 illustrating the locking of the latch in the landing nipple.
Figure 4:
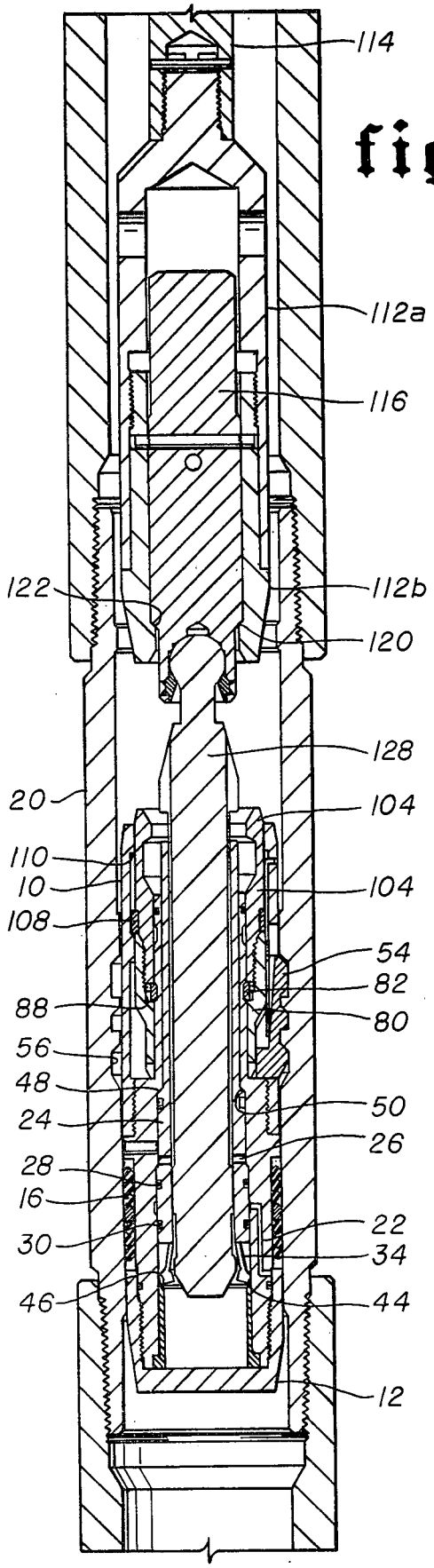
FIG. 4 is a sectional view of the latch and running tool of FIG. 2 with the the latch locked in the landing nipple and running tool being retrieved from the well.

The running tool for this first embodiment of a high pressure latch is shown in FIGS. 2, 3 and 4.

The running tool includes an outer mandrel 112 having interconnected section **112*a* and 112*b*. The running tool mandrel 112 is attached to the pumpdown tool train (not shown) by connector 114**.

Within the mandrel 112 is disposed a plunger element 116. The plunger element 116 is axially movable with respect to the mandrel 112 between a first extended position (as illustrated in FIG. 2) and a second retracted position (as illustrated in FIG. 3). Shear pin 118 releasably maintains plunger element 116 in its first extended position. After shear pin 118 has been sheared, plunger element 116 is prevented from moving past its first extended position by the engagement of a shoulder 120 of plunger 116 and a shoulder 122 of mandrel 112.

At one end **116*a* of plunger element 116 is formed a socket 124. The socket 124 receives the ball 126 formed on one end of the running tool prong 128**.

At the other end of the running tool prong 128 is formed head 130. The head 130 has a shoulder 132 for engaging the inwardly facing shoulder 32 of the latch valve means 24. The head 130 is sized so that when valve means 24 is in its first position with its inwardly facing shoulder 32 engaging and confining the prong head shoulder 132, the tip 134 of the prong head 130 engages a stop surface 136 which is stationary with respect to latch housing 10.

Figure 5:
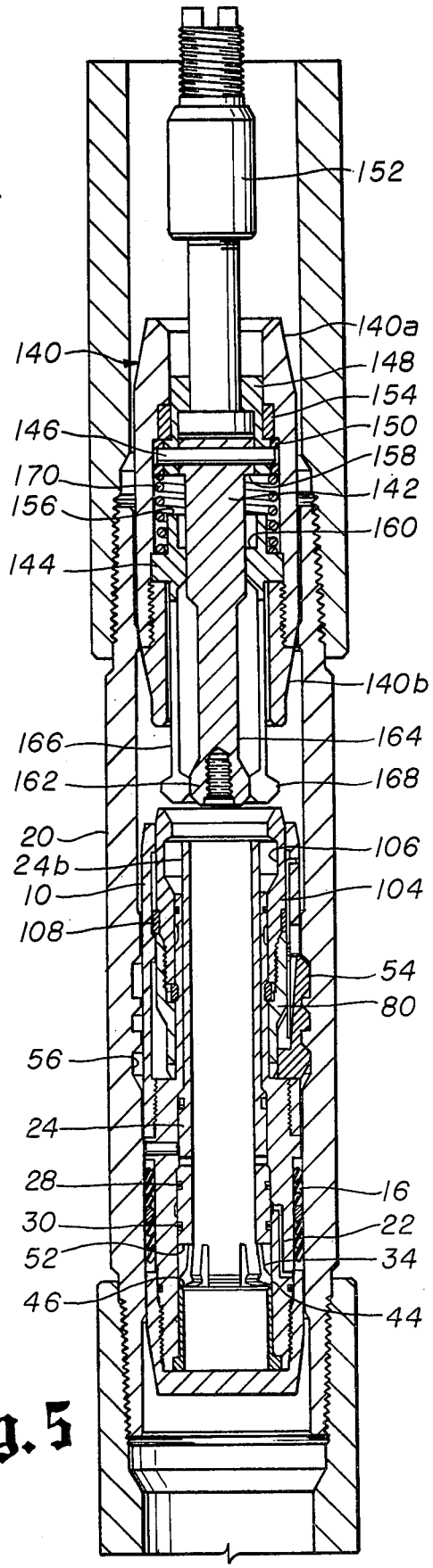
FIG. 5 is a sectional view of the latch of FIG. 1 locked in the landing nipple prior to engagement by a retrieving tool.
Figure 6:
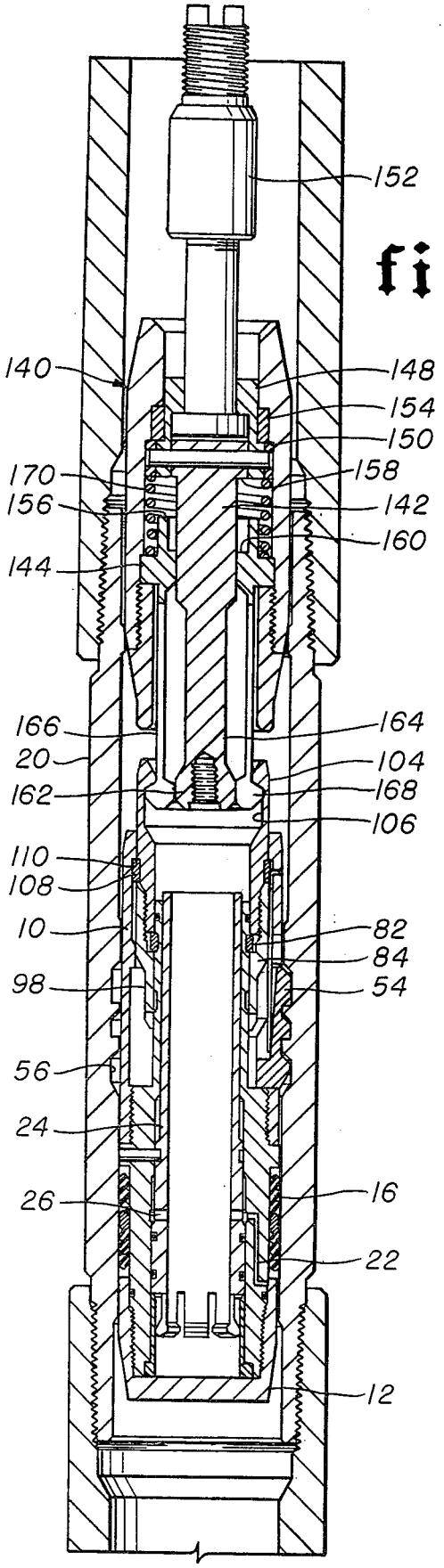
FIG. 6 is a sectional view of the latch after engagement by the retrieving tool.

The pulling tool for the high pressure latch is illustrated in FIGS. 5 and 6.

The pulling tool includes a tool body 140 formed of interconnected sections **140*a* and 140*b*. In the tool body 140 is disposed an axially movable plunger 142 and a stationary collet latching means 144. An emergency shear pin 146 releasably joins the plunger 142 to a movable shear sub 148 and shear ring 150. Axially movable through the shear sub 148 is a connector 152. Connector 152 is associated with the pumpdown tool train (not shown). A spacer ring 154 is carried by the tool body 140 and prevents emergency shear pin 146 from shearing when plunger 142 is moved upwardly with respect to the tool body 140. In an emergency, if after the pulling tool has engaged the latch, it is decided to leave the latch locked in the landing nipple, the plunger 142 is jarred downwardly with respect to the tool body 140. Shear sub 148 engages an annular surface 156 of collet latching means 144 and produces a force which shears emergency shear pin 146. The plunger 142 is thereafter able to gravitate downwardly with respect to the tool body 140 until it attains its extreme extended position. At that extreme extended position, its shoulder 158 engages a shoulder 160 of collet latching means 144**.

The lower end of plunger element 142 comprises an enlarged head 162 above which extends a reduced diameter portion 164.

The lower portion of latching collet means 144 comprises a plurality of collet fingers 166 each of which includes a collet head 168 at its lower end.

When the pulling tool is being run in the well flow conductor to retrieve the latch, the plunger 142 is biased to a first upward position with respect to the tool body 140 by spring means 170. In this first position of plunger 142, the plunger head 162 is disposed behind the collet heads 168 and mantains them in an outward position. Downward movement of plunger 142 with respect to the tool body 140, caused by a downward force being applied to connector 152, will be arrested by the engagement of shear sub 148 with annular shoulder 156. At this intermediate, extended position of the plunger 142, the plunger's reduced diameter portion 164 is disposed behind the collet heads 168. Collet fingers 166 allow collet heads 168 to move to a contacted position. If the emergency shear pin 146 has been sheared and plunger 142 has gravitated to its extreme extended position, the reduced diameter portion 164 of plunger 146 will be disposed behind collet heads 168. The collet heads 168 may assume their contracted position when plunger 142 is in one of its intermediate or extreme extended positions.

In operation, the latch of this invention lands, locks and seals well equipment in a well flow conductor. The latch is short so that it may pass through curved portions of the well flow conductor.

To run the latch into the well, the running tool would be connected to the end of the tool train with connector 114. The latch valve means 24 is moved to its second upward position so that collet fingers 34 expand outwardly. The running tool prong 128 is inserted therethrough until its head 130 extends beyond the lower inwardly facing shoulder 32 of the valve means 24. Valve means 24 and the running tool prong 128 are moved together until valve means 24 is in its first downward position. The prong head 130 is thereby confined between the lower inwardly facing shoulder 32 of valve means 24 and the surface 136, as illustrated in FIG. 2. Shear pin 38 is threaded into the socket 40. Engagement of shear pin 38 with the groove 42 of valve means 24 releasably maintains valve means 24 in the position shown in FIG. 2 with valve means 24 releasably engaging the running tool prong 128. The plunger element 116 of the running tool is moved to its first extended position and shear pinned, with pin 118, to the tool mandrel 112. The running tool mandrel 112 is now spaced from the latch housing 10 with the ball 126 and socket 124 of the prong 128 and plunger element 116 disposed therebetween. Expander means 80 is moved to its first position and releasably maintained therein by the engagement of detent ring means 82 with groove means 84. The latch and running tool are now ready to be run in the well flow conductor.

During the running of the running tool and latch through the well flow conductor, the latch is able to articulate with respect to the running tool due to the universal connection between the running tool prong 128 to the plunger element 116. Spring means 76 resiliently urges key means 54 outwardly. When key means 54 encounters a restriction within the well flow conductor, its chamfered shoulder 68 cams it inwardly. Due to the inwardly stepped surface of key means 54 and the outer stepped portion of expander means 80, key means 54 is capable of retracting fully within the windows 58 of the latch housing 10. With key means 54 retracted, restrictions in the well flow conductor can be bypassed. The running tool and latch move through the flow conductor until key means 54 is opposite the landing nipple recess 56. Key means 54 is expanded outwardly into the recess 56 by spring means 76. The shoulders 60 and 62 of key means 54 positively engage the shoulders 64 and 66 of the recess 56 to stop further movement of the latch and running tool The latch and running tool are in the configuration shown in FIG. 2. Equalizing passage means 22 is still opened. Key means 54 are not yet locked in their expanded position.

A continued application of force, in a first, downward, direction applied to the running tool, locks key means 54 in their expanded position. A downward application of force to the running tool will shear running tool shear pin 118. The running tool mandrel 112 moves downwardly with respect to plunger element 116. The lower end of the running tool mandrel 112 engages the upper end of fishing neck means 104. A downward application of force is continued. Since fishing neck means 104 is associated with expander means 80, initial movement of fishing neck means 104 and expander means 80 is resisted due to the engagement of detent ring means 82 with groove means 84. Detent ring means 82 is cammed outwardly into recess 88. With continued downward force applied to the running tool mandrel 112, fishing neck means 104 and expander means 80 are moved downwardly until expander means 80 is in its second position. Detent ring means 82 moves along with expander means 80 and engages groove means 86 when expander means 80 reaches its second position. The running tool and latch are now in the configuration illustrated in FIG. 3. Key means 54 are backed up by expander means 80 and are locked in their expanded position. However, equalizing passage means 22 remains open and the head 130 of the running tool prong 128 remains confined by inwardly facing shoulder 32.

An upward application of force to the running tool closes the equalizing passage means 22 and permits the retrieval of the running tool through the well flow conductor. The initial upward application of force to the running tool moves the tool mandrel 112 upwardly until its shoulder 122 engages plunger element shoulder 120. Thereafter upward forces are transmitted from the running tool mandrel 112 through plunger element 116, prong 128 and valve means 24. This transmission of upward forces applies a shearing load to latch shear pin 38. A sufficient upward force application shears latch shear pin 38. Thereafter, a continued upward application of force to the running tool moves valve means 24 to its second position. Valve means 24 is stopped when it reaches this second position by the engagement of its shoulder 48 with latch housing shoulder 50. When valve means 24 reaches its second position, collet fingers 34 spring outwardly. The prong head 130 can pass through the inwardly facing shoulder 32 of collet fingers 34. The prong 128 may be withdrawn from the latch (as seen in FIG. 4) and the latch retrieved from the well flow conductor.

The latch is now locked in the landing nipple 20 of the well flow conductor. Seal means 16 seals between the latch housing 10 and the landing nipple 20. Valve means 24 prevents flow through equalizing passage means 22. Two pressure regions are established, one above the latch and the other below the latch. The well equipment 12, which is associated with the latch, is now landed, locked and sealed the well flow conductor.

To retrieve the latch and associated well equipment 12 from the well, the pulling tool is connected to the end of a tool train (not shown) with connector 152. The tool train is run through the well flow conductor until the pulling tool reaches the location of the latch. As the pulling tool approaches the latch, (see (FIG. 5) the head 162 of plunger 142 remains disposed between the collet heads 168 of collet latching means 144. As long as the plunger head 162 is disposed behind the collet heads 168, the collet heads 168 cannot retract and cannot be received within fishing neck means 104.

The pulling tool encounters the latch and is operated to engage the latch fishing neck means 104. The first interaction between the pulling tool and latch occurs when the collet heads 168 of the pulling tool strike the top of the latch's fishing neck means 104. An application of force to the tool train in a first, downward, direction moves connector 152 and plunger 142 downwardly with respect to the pulling tool body 140. The plunger is stopped at its intermediate, extended position. The reduced diameter portion 164 of plunger 142 is thereby moved to a position behind the collet heads 168. The collet heads 168 can now move inwardly. A continued application of force to the tool train in a first direction, forces the collet heads 168 inwardly into fishing neck means 104. However, the extension 24*b* of valve means 24 prevents the collet heads 168 from engaging the recess 106 of fishing neck means 104. The collet heads 168 instead engage the upper end of valve means 24. Movement of valve means 24 from its second position is initially resisted by the engagement of the outward facing shoulders 44 of valve collet fingers 34 with the upper end 46 of sleeve means 36 in the latch housing 10. Force is continued to be applied to the tool train in the first direction until this releasable stop means for valve means 24 is overcome. The collet fingers 34 chamfer inwardly. Valve means 24 moves to its first position with its stop shoulder 52 engaging the upper end 46 of sleeve means 36. Flow through pressure equalizing passage means 12, which equalizes the pressre across seal means 16, is permitted. The pulling tool collet heads 168 have now engaged the internal recess 106 of fishing neck means 104.

An application of force to the tool train in a second, upward, direction initially moves the plunger 142 and connector 152 upwardly. Their upward movement is arrested by the engagement of shear sub 148 with spacer ring 154. The plunger 142 is thus returned to its first position. Its enlarged head 162 is disposed under the collet heads 168 maintaining them engaged with fishing neck recess 106.

A continued application of force in this second direction unlocks the latch from the landing nipple 20 and retrieves the latch from the well flow conductor. The collet heads 168 of the pulling tool will remain engaged with the fishing neck means 104. Movement of fishing neck means 104 is initially resisted due to the engagement of detent ring means 82 with lower groove means 86. Upon a sufficient upward application of force, detent ring means 82 is cammed outwardly into recess 88. Fishing neck means 104 and the associated expander means 80 are now movable with respect to the latch housing 10 to the expander's first position. When expander means 80 is moved to its first postion, due to the forces being applied through the pulling tool and fishing neck means 104, load ring means 108 engages the latch housing shoulder 110. At the same time, key means 54 are permitted to retract inwardly into the latch housing 10. A continued application of force, in a second, upward direction, applied to the tool train will chamfer key means 54 inwardly. Improved force transmission between fishing neck means 104 and the latch housing 10 is provided by the engagement of load ring means 108 with shoulder 110. The latch can now be retrieved from the well as seen in FIG. 6.

Figure 7:
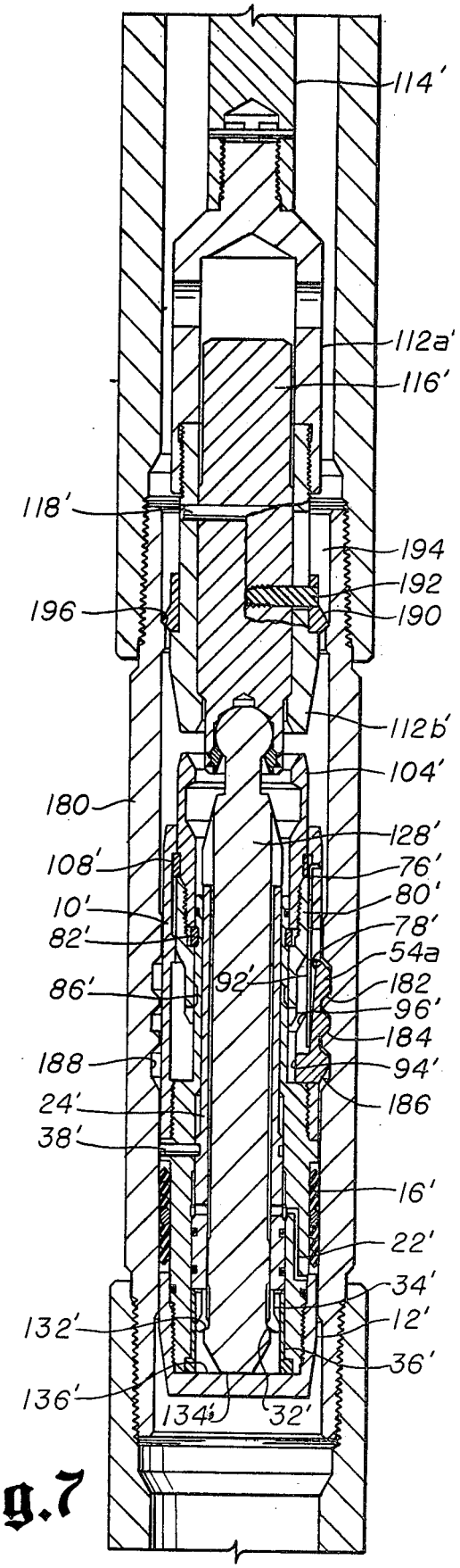
FIG. 7 is a sectional view of an alternate embodiment of a latch and its alternate running tool being located in the well conduit with the latch in the landing nipple.
Figure 8:
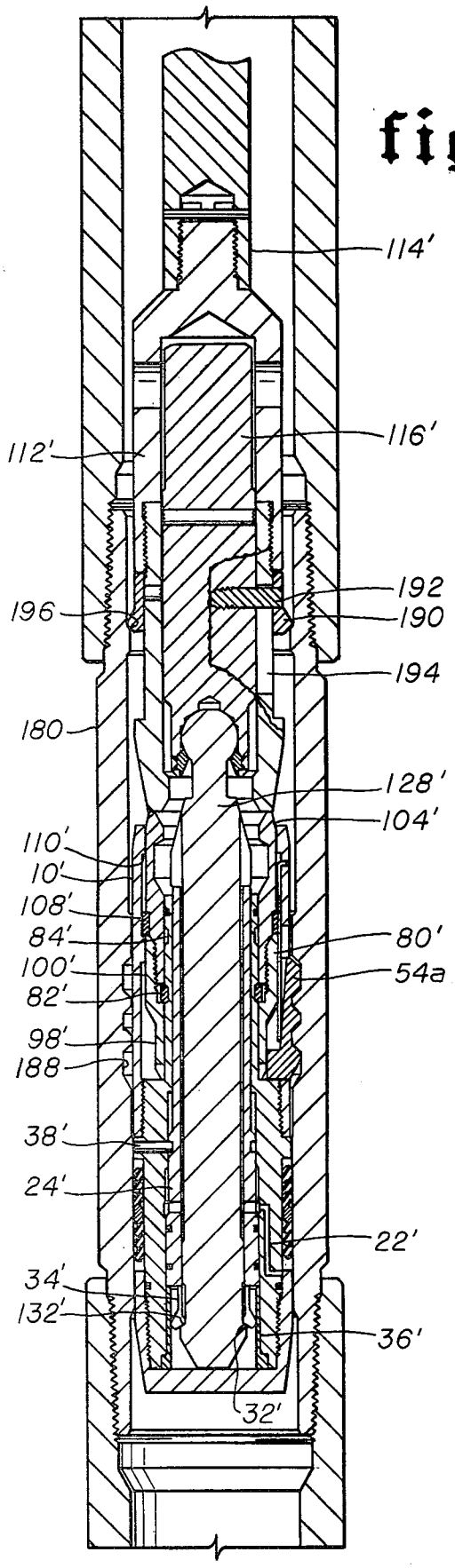
FIG. 8 is a sectional view similar to FIG. 3 illustrating the locking of this alternate embodiment of the latch by the running tool in the landing nipple.
Figure 9:
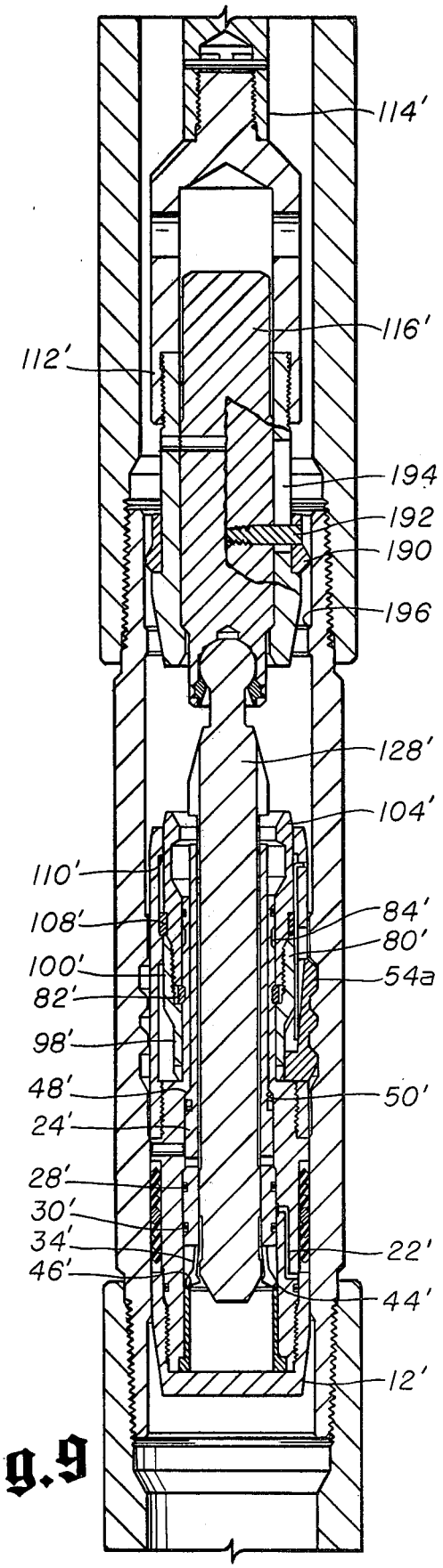
FIG. 9 is a sectional view of this alternate latch embodiment locked in the landing nipple and the alternate running tool being retrieved from the well.

FIGS. 7, 8 and 9 illustrate an alternate embodiment of a latch and running tool in accordance with this invention.

Except for key means **54*a***, the elements of the latch of this second embodiment correspond to the elements of the latch of the first embodiment. These corresponding elements have been designated with the corresponding numerals except for the addition of a'.

The key means **54*a* of this second embodiment locks the latch in a landing nipple 180. Key means 54*a* does not locate the latch with respect to a landing nipple as do key means 54 of the first embodiment. The outer profile of key means 54*a* includes downward facing chamferred surfaces 182, 184 and 186. These chamferred surfaces cam key means 54*a* inwardly when a restriction is encountered as the latch means downwardly through the well flow conductor. Except for chamferred surfaces 182, 184 and 186 key means 54*a* is the same as the key means 54** of the first embodiment.

The running tool includes means for stopping and locating the tool train in the well flow conductor. The running tool stops the tool train when the latch is in the landing nipple 180 with key means **54*a* opposite the landing nipple recess 188**.

The running tool of this second embodiment also includes elements which correspond to the elements of the running tool of the first embodiment previously described. These corresponding elements have also been designated with the corresponding numerals except for the addition of a'. In addition to the elements previously described, the running tool includes a stop means, such stop collar 190 carried on tool mandrel 112'. Stop collar 190 is attached to the tool plunger element 116' by pin means 192. Pin means 192 extends through a slot 194 formed within mandrel 112'. Stop means 190 is therefore stationary with respect to the movable plunger element 116' and moves therewith after shear pin 118' has been sheared.

The operation of this second embodiment is similar to the operation of the first embodiment.

The latch and running tool are joined as part of a tool train in the manner previously described.

The tool train is run through the well flow conductor until stop means 190 of the running tool engages a stop shoulder 196 in the landing nipple 180. When the tool train is stopped latch key means **54*a* are opposite the landing nipple recess 188. They are resiliently expanded outwardly into the recess 188 by spring means 76'**. (See FIG. 7.)

Once the running tool is stopped, and key means **54*a* have expanded into the recess 188, a continued application of force in a first, downward direction, shears running tool shear pin 118'. Thereafter the running tool operates to lock the latch in the landing nipple 180 in the manner previously described. The latch valve means 24' is also moved to its position preventing flow through equalizing passage means 22' and releasing the running rool prong 128'** in the manner previously described.

The latch may be retrieved with a pulling tool in the manner previously described.

From the foregoing it can be seen that the objects of this invention have been obtained. A high pressure latch for pumpdown use has been provided. Any desired well tool may be connected to the latch. The latch comprises one short section of a pumpdown tool train. It is therefore able to negotiate a short radius of curvature which may be present in the well flow conductor. The longitudinal length of the latch is kept to a minimum by reducing the distance that a key expander moves between its (the expander's) effective and ineffective positions. The longitudinal length of the latch is also shortened by the arrangement of the pressure equalizing passage and valve. Additionally, a major portion of the fishing neck is received within the latch housing. Once the latch has been locked in position in the well, the equalizing passage is closed by the valve and the latch cannot be retrieved from the well without moving the valve to a position permitting pressure equalization through the equalizing passage.

The foregoing disclosure and description of the invention are illustrative and explanatory thereof. Various changes in the size, shape, and materials, as well as the details of the illustrated construction, may be made within the scope of the appended claims without departing from the spirit of the invention.

What is claimed is:

1. A well latch comprising:

a latch housing;

seal means on said housing for sealing between said latch housing and a landing nipple in a well;

said latch housing having equalizing passage means for extending between a first pressure region exterior of said latch housing and a second pressure region interior of said housing;

key means carried by said housing and adapted to move radially outwardly for locking the well latch in a landing nipple;

expander sleeve means axially movable with respect to said latch housing between a first position permitting retraction of said key means into said latch housing and a second position maintaining said key means in an expanded position;

fishing neck means associated with said expander sleeve means and movable in unison with said expander sleeve means with respect to said latch housing and including recess means for engagement by a fishing tool;

valve means disposed in said latch housing and movable independently of said expander sleeve means with respect to said latch housing between a first position permitting flow through said equalizing passage means and a second position preventing flow through said equalizing passage means, said valve means being adapted to be moved to its second position when the well latch is locked in a landing nipple;

releasable stop means for preventing unintentional movement of said valve means from its second position to its first position; and means associated with said valve means for preventing a fishing tool from engaging said fishing neck recess means until said valve means is moved to its first position and including an extension on said valve means, said extension extending across said recess means and interferring with access to said recess means when said valve means is in its second position and said expander sleeve means is in its second position and not interferring with access to said recess means when said valve means is in its first position.

2. The well latch of claim 1 wherein:

said key means includes an inner stepped surface; and said expander sleeve means includes an outer stepped portion for engaging said inner stepped surface of said key means when said expander sleeve means is in its second position and including at least one stepped portion which is behind a portion of said inner stepped surface of said key means when said expander sleeve means is in its first position.

3. The well latch of claim 1 additionally including:

means for releasably maintaining said expander sleeve means in one of its first and second positions.

4. The well latch of claim 1 additionally including:

releasable holding means for releasably holding said valve means in said first position until said key means have expanded outwardly and locked said latch in a landing nipple.

5. A well latch comprising:

a latch housing;

seal means on said housing for sealing between said latch housing and a landing nipple in a well;

said latch housing having equalizing passage means for extending between a first pressure region exterior of said latch housing and a second pressure region interior of said housing;

key means carried by said latch housing and adapted to move radially outwardly for locking the well latch in a landing nipple;

expander sleeve means axially movable with respect to said latch housing between a first position permitting retraction of said key means into said latch housing and a second position maintaining said key means in an expanded position;

fishing neck means associated with said expander sleeve means and including recess means for engagement by a fishing tool;

valve means disposed in said latch housing and movable between a first position permitting flow through said equalizing passage means and a second position preventing flow through said equalizing passage means, said valve means being adapted to be moved to its second position when the well latch is locked in a landing nipple;

releasable stop means for preventing unintentional movement of said valve means from its second position to its first position;

means associated with said valve means for preventing a fishing tool from engaging said fishing neck recess means until said valve means is moved to its first position;

downwardly facing shoulder means on said latch housing;

groove means formed between said expander sleeve means and said fishing neck means; and load ring means disposed in said groove means and including a portion extending beyond said groove means for engaging said downwardly facing shoulder means upon movement of said expander means to said first position;

whereby a load is transferred from said fishing neck means to said housing upon an upward application of force to said fishing neck means to said load ring means engaging said downward facing shoulder means.

6. A well latch comprising:

a latch housing;

seal means on said latch housing for sealing between said latch housing and a landing nipple in a well;

said latch housing having equalizing passage means for extending between a first pressure region exterior of said latch housing and a second pressure region interior of said latch housing;

key means carried by said latch housing and adapted to move radially outwardly for locking the well latch in a landing nipple;

expander sleeve means axially movable with respect to said latch housing between a first position permitting retraction of said key means into said housing and a second maintaining said key means in an expanded position;

said key means including an inner stepped surface a major portion of said surface being aligned essentially axially with said latch housing;

said expander sleeve means including an outer stepped portion for extending along and engaging substantially the entire axially aligned portion of said inner stepped surface of said key means when said expander sleeve means is in its second position and including at least one stepped portion which is behind a portion of said inner stepped surface of said key means when said expander sleeve means is in its first position;

fishing neck means associated with said expander sleeve means and movable in unison with said expander sleeve means with respect to said latch housing and including fishing neck recess means for engagement by a fishing tool;

valve means disposed in said latch housing and movable independently of said expander sleeve means and with respect to said latch housing between a first position permitting flow through said equalizing passage means and a second position preventing flow through said equalizing passage means, said valve means being adapted to be moved to its second position when the well latch is locked in a landing nipple; and releasable stop means for preventing unintentional movement of said valve means from its second position to its first position.

7. The well latch of claim 6 wherein:

the inner stepped surface of said key means includes a first surface forming a first step, a second surface forming a second step and a tapered surface extending between said first and second surfaces; and the outer stepped portion of said expander sleeve means includes means for engaging said stepped surfaces of said key means when said expander sleeve means is in said second position which means includes a reduced outside diameter portion, an enlarged outside diameter portion and a tapered portion extending between said reduced and enlarged diameter portions, said reduced diameter portion being positioned behind one of said first and second surfaces of said key means when said expander sleeve means is in its first position and being behind the other of said first and second surfaces of said key means when said expander sleeve means is in its second position and said enlarged diameter portion being behind said one of said first and second surfaces of said key means when said expander sleeve means is in its second position.

8. The well latch of claim 6 additionally including:

means for releasably maintaining said expander sleeve means in one of its first and second positions.

9. The well latch of claim 6 additionally including:

releasable holding means for releasably holding said valve means in said first position until said key means have expanded outwardly and have locked the latch in a landing nipple.

10. A well latch comprising:

a latch housing;

seal means on said latch housing for sealing between said latch housing and a landing nipple in a well;

said latch housing having equalizing passage means for extending between a first pressure region exterior of said latch housing and a second pressure region interior of said latch housing;

key means carried by said latch housing and adapted to move radially outwardly for locking the well latch in a landing nipple;

expander sleeve means axially movable with respect to said latch housing between a first position permitting retraction of said key means into said housing and a second position maintaining said key means in an expanded position;

said key means including an inner stepped surface;

said expander sleeve means including an outer stepped portion for engaging said inner stepped surface of said key means when said expander sleeve means is in its second position and including at least one stepped portion which is behind a portion of said inner stepped surface of said key means when said expander sleeve means is in its first position;

fishing neck means associated with said expander sleeve means and including fishing neck recess means for engagement by a fishing tool;

valve means disposed in said latch housing and movable between a first position permitting flow through said equalizing passage means and a second position preventing flow through said equalizing passage means, said valve means being adapted to be moved to its second position when the well latch is locked in a landing nipple;

releasable stop means for preventing unintentional movement of said valve means from its second position to its first position;

downwardly facing shoulder means on said housing;

groove means formed by said expander sleeve means and said fishing neck means; and load ring means disposed in said groove means and including a portion extending beyond said groove means engaging said downwardly facing shoulder means when said expander sleeve means is in said first position;

whereby a load is transferred from said fishing neck means to said housing upon an upward application of force to said fishing neck means due to said load ring means engaging said downwardly facing shoulder means.

11. A well latch comprising:

a latch housing;

seal means on said latch housing for sealing between said latch housing and a landing nipple in a well;

said latch housing having equalizing passage means for extending between a first pressure region exterior of said latch housing and a second pressure region interior of said latch housing;

key means carried by said latch housing and adapted to move radially outwardly for locking the well latch in a landing nipple in a well;

expander means axially movable with respect to said latch housing between a first position permitting retraction of said key means into said latch housing and a second position maintaining said key means in an expanded position;

means for releasably maintaining said expander means in one of its first and second positions;

fishing neck means associated with said expander means and including fishing neck recess means for engagement by a fishing tool;

valve means disposed in said latch housing and movable between a first position permitting flow through said equalizing passage means and a second position preventing flow through said equalizing passage means, said valve means being adapted to be moved to its second position when the well latch is locked in a landing nipple;

releasable stop means for preventing unintentional movement of said valve means from its second position to its first position;

wherein said means for releasably maintaining said expander means includes expandable and contractible means carried by said expander means; and said latch housing has two spaced groove means for releasably engaging said expandable and contractible means;

said expandable and contractible means engaging one of said two spaced groove means when said expander means is in one of its first and second positions and engaging the other of said two spaced groove means and when said expander means is in the other of its first and second positions.

12. The well latch of claim 11 additionally including:

seal means for sealing between said latch housing and said expander sleeve means and located between the extreme end of said latch housing and said two spaced groove means and above said two spaced groove means.

13. A well latch comprising:

a latch housing;

seal means on said latch housing for sealing between said latch housing and a landing nipple in a well;

said latch housing having equalizing passage means for extending between a first pressure region exterior of said latch housing and a second pressure region interior of said latch housing;

key means carried by said latch housing and adapted to move radially outwardly for locking the well latch in a landing nipple in a well;

expander means axially movable with respect to said latch housing between a first position permitting retraction of said key means into said latch housing and a second position maintaining said key means in an expanded position;

means for releasably maintaining said expander means in one of its first and second positions;

fishing neck means associated with said expander means and including fishing neck recess means for engagement by a fishing tool;

valve means disposed in said latch housing and movable between a first position permitting flow through said equalizing passage means and a second position preventing flow through said equalizing passage means, said valve means being adapted to be moved to its second position when the well latch is locked in a landing nipple;

releasable stop means for preventing unintentional movement of said valve means from its second position to its first position;

downwardly facing shoulder means on said housing;

groove means formed in said expander means and said fishing neck means; and load ring means disposed in said groove means and including a portion extending beyond said groove means for engaging said downwardly facing shoulder means when said expander means is in said first position;

whereby a load is transferred from said fishing neck means to said latch housing upon an upward application of force to said fishing neck means due to said load ring means engaging said downwardly facing shoulder means.

14. A well latch comprising:

a latch housing;

seal means on said latch housing for sealing between said latch housing and a landing nipple in a well;

said latch housing having equalizing passage means for extending between a first pressure region exterior of said latch housing and a second pressure region interior of said latch housing;

valve means disposed in said latch housing and movable between a first position permitting flow through said equalizing passage means and a second position preventing the flow through said equalizing passage means, said valve means being adapted to be moved to its second position when the well latch is locked in a landing nipple;

key means carried by said latch housing and adapted for movement radially outwardly for locking the well latch in a landing nipple in the well;

expander means axially movable with respect to said latch housing between a first position permitting retraction of said key means into said latch housing and a second position maintaining said key means in an expanded position;

releasable holding means for releasably holding said valve means in said first position until said key means have been expanded outwardly by said expander means and have locked the well latch in a landing nipple in the well;

fishing neck means associated with said expander means and including fishing neck recess means for engagement by a fishing tool;

releasable stop means for preventing unintentional movement of said valve means from its second position to its first position;

downwardly facing shoulder means on said latch housing;

groove means formed by said expander means and said fishing neck means; and load ring means disposed in said groove means and including a portion extending beyond said groove means for engaging said downwardly facing shoulder means;

whereby a load is transferred from said fishing neck means to said latch housing upon an upward application of force to said fishing neck means due to said load ring means engaging said downwardly facing shoulder means.

15. A well latch comprising:

a latch housing;

seal means on said latch housing for sealing between said latch housing and a landing nipple in a well;

said latch housing having equalizing passage means extending between a first pressure region exterior of said latch housing and a second pressure region interior of said latch housing;

valve means disposed in said latch housing and movable between a first position permitting flow through said equalizing passage means and a second position preventing flow through said pressure equalizing pressure means, said valve means being adapted to be moved to its second position when the well latch is locked in a landing nipple;

key means carried by said latch housing and adapted for movement radially outwardly for locking the well latch in a landing nipple in the well;

expander means axially movable with respect to said latch housing between a first position permitting retraction of said key means into said latch housing and a second position maintaining said key means in an expanded position;

fishing neck means associated with said expander sleeve means and including fishing neck recess means for engagement by a fishing tool;

releasable stop means for preventing unintentional movement of said valve means from its second position to its first position;

downwardly facing shoulder means on said latch housing;

groove means formed by said expander sleeve means and said fishing neck means;

load ring means disposed in said groove means and including a portion extending beyond said groove means for engaging said downwardly facing shoulder when said expander sleeve means is in said first position;

whereby a load is transferred from said fishing neck means to said latch housing upon an upward application of force to said fishing neck means due to said load ring means engaging said downwardly facing shoulder means.

16. A well latch comprising:

a latch housing;

seal means on said latch housing for sealing between said latch housing and a landing nipple in a well;

said latch housing having equalizing passage means extending between a first pressure region exterior of said latch housing and a second pressure region interior of said latch housing;

valve means disposed in said latch housing and movable between a first position permitting flow through said equalizing passage means and a second position preventing flow through said equalizing passage means, said valve means being adapted to be moved to its second position when the well latch is locked in a landing nipple;

key means carried by said latch housing and adapted for movement radially outwardly with respect to said latch housing for locking the well latch in a landing nipple in a well;

expander means axially movable with respect to said latch housing between a first position permitting retraction of said key means into said housing and a second position maintaining said key means in an outward, expanded position;

said key means including an inner stepped surface having a first surface forming a first step, a second surface forming a second step, and a tapered surface extending between said first and second surfaces;

said expander means including an outer stepped portion for engaging said stepped surfaces of said key means when said expander sleeve means is in said second position, said stepped portions including a reduced outside diameter portion, an enlarged outside diameter portion, and a tapered diameter portion extending between said reduced and said enlarged diameter portions, said reduced diameter portion being positioned behind one of said first and second surfaces of said key means when said expander sleeve means is in its first position and being behind the other of said first and second surfaces of said key means when said expander sleeve means is in its second position and said enlarged diameter portion being behind said one of said first and second surfaces of said key means when said expander sleeve means is in its second position;

fishing neck means associated with said expander sleeve means and including fishing neck recess means for engagement by a fishing tool;

downwardly facing shoulder means on said latch housing;

groove means formed by said expander sleeve means and said fishing neck means;

load ring means disposed in said groove means and including a portion extending beyond said groove means for engaging said downwardly facing shoulder means when said expander sleeve means is in its first position;

releasable stop means for preventing unintentional movement of said valve means from its second position to its first position;

means associated with said valve means for preventing a fishing tool from engaging said recess means until said valve means is moved to its first position;

means for releasably maintaining said expander sleeve means in one of its first and second positions; and releasable holding means for releasably holding said valve means in its first position until said key means has expanded outwardly and locked the well latch in a landing nipple in the well.

17. The well latch of claim 16 wherein:

said means for preventing a fishing tool from engaging said recess means includes an extension on said valve means, said extension interferring with access to said recess means when said valve means is in its second position and said expander sleeve is in its second position and not interferring with access to said recess means when said valve means is in its first position.

18. The well latch of claim 16 wherein said means for releasably maintaining said expander sleeve means in one of its first and second positions includes:

expandable and contractible detent ring means carried by said expander sleeve means; and two spaced groove means formed in said latch housing for releasably engaging said expandable and contractible detent ring means;

said detent ring means engaging one of said two spaced groove means when said expander sleeve means is in one of its first and second positions and engaging the other of said two spaced groove means when said expander sleeve means is in the other of its first and second positions.

19. The latch of claim 11 additionally including seal means for sealing between said latch housing and said expander sleeve means.

* * * * *